US007125240B2

(12) United States Patent
Jakoby et al.

(10) Patent No.: US 7,125,240 B2
(45) Date of Patent: Oct. 24, 2006

(54) DEVICE FOR WITHDRAWING A BAR PRODUCED IN A BAR EXTRUDER OR PIPE EXTRUDER

(75) Inventors: Nikolaus Jakoby, Ratingen (DE); Johannes Steves, Erkrath (DE); Stephan Frehe, Erkrath (DE); Herbert Süther, Düsseldorf (DE)

(73) Assignee: SMS Eumuco GmbH, Leverkusen (DE)

( * ) Notice: Subject to any disclaimer, the term of this patent is extended or adjusted under 35 U.S.C. 154(b) by 104 days.

(21) Appl. No.: 10/507,527

(22) PCT Filed: Feb. 26, 2003

(86) PCT No.: PCT/DE03/00599

§ 371 (c)(1),
(2), (4) Date: Sep. 10, 2004

(87) PCT Pub. No.: WO03/076098

PCT Pub. Date: Sep. 18, 2003

(65) Prior Publication Data

US 2005/0142241 A1 Jun. 30, 2005

(30) Foreign Application Priority Data

Mar. 11, 2002 (DE) ..... 102 10 475

(51) Int. Cl.
*B29C 43/50* (2006.01)
*B29C 45/42* (2006.01)

(52) U.S. Cl. ..... 425/436 RM; 425/436 R; 425/444

(58) Field of Classification Search ..... 425/436 R, 425/444, 436 RM
See application file for complete search history.

(56) References Cited

U.S. PATENT DOCUMENTS 1,821,128 A * 9/1931 Weir ..... 425/436 R
1,961,261 A * 6/1934 Ukropina ..... 425/153
2,940,119 A * 6/1960 Perrault ..... 425/436 R
2,994,919 A * 8/1961 Schafer et al. ..... 425/446
2,997,737 A * 8/1961 Boggs et al. ..... 425/436 R
3,829,273 A * 8/1974 Okada et al. ..... 425/444
3,946,483 A * 3/1976 Holden et al. ..... 425/436 RM
4,358,264 A * 11/1982 Yamamoto et al. ..... 425/426
5,693,347 A * 12/1997 Hegler ..... 425/233

* cited by examiner

*Primary Examiner*—Joseph S. Del Sole
*Assistant Examiner*—Emmanuel S. Luk
(74) *Attorney, Agent, or Firm*—Andrew Wilford

(57) ABSTRACT

A withdrawing device for a press that outputs an elongated workpiece in a direction has a first guide extending in the direction and carrying a first carriage movable by a first motor. A second guide extending in the direction on the first carriage carries a second carriage displaceable in the direction on the second guide by a second motor. The workpiece is clamped to the second carriage. A controller is connected to the first and second motors for shifting the second carriage in the direction at a speed independent of a speed of the first carriage while the first carriage is moving in the direction.

10 Claims, 5 Drawing Sheets

DEVICE FOR WITHDRAWING A BAR PRODUCED IN A BAR EXTRUDER OR PIPE EXTRUDER

CROSS REFERENCE TO RELATED APPLICATIONS

This application is the US national phase of PCT application PCT/DE03/00599, filed 26 Feb. 2003, published 18 Sep. 2003 as WO 03/076098, and claiming the priority of German patent application 10210475.1 itself filed 11 Mar. 2002.

FIELD OF THE INVENTION

The invention relates to a device for withdrawing a bar produced in a bar or pipe extruder which has at least a driven linearly movable carriage which is movable in the withdrawal direction of the bar and can exert a tension force upon the bar.

BACKGROUND OF THE INVENTION

A device of this kind is known from EP 0 300 262 B1 (U.S. Pat. No. 4,995,253). For producing a bar of high quality in a bar or tube press it has been recognized as necessary for the bar to be withdrawn from the die of the bar or tube press with a defined withdrawal force. In this manner it can be ensured that the bar formation in the die will not be negatively influenced. To ensure a high quality of the bar a withdrawal device has been described with which the end of the bar to be withdrawn is affixed to a carriage movable on a rail. The carriage is connected with drive means so that a tension force can be applied to the bar. For optimal finishing results, the tension force is a combination of different components, whereby especially one component is determined as a function of the pressed-out bar length.

In this manner the cross sectional tolerances of the bar withdrawn from the bar press can be reduced so that the bar has the desired quality. This system is based upon the consideration that the bar, with increasing spacing from the die, as a result of the cooling, can be loaded with increasing tension without producing a cross sectional change.

It has been found problematical in this context that different forces are applied to the withdrawal carriage over the withdrawal path so that it is very difficult to ensure a defined withdrawal force, for example conforming to a predetermined function, which can be applied to the bar end.

The carriage or puller truck has a mass and is driven by a motor. The speed and torque of the motor can be predetermined by a control. The motor force applied to the carriage, which is converted into the withdrawal force applied to the extrusion pressed profile or strand, will depend upon the friction force of the mounting of the carriage as well as the initial forces which are dependent upon the actual acceleration of the carriage. Only in a static case will the motor force correspond to the withdrawal force, because in that case the speed and the friction are zero. When the profile or strand moves, the friction force and inertial forces on the carriage are not constant and the friction coefficient will depend upon environmental conditions (temperature, contamination of the path). As a consequence it becomes very difficult to apply a defined predetermined withdrawal force to the bar to be withdrawn. If the carriage is accelerated at the beginning of the withdrawal process the force equilibrium is destroyed as a consequence of the inertial forces which arise so that there are special difficulties in maintaining a defined withdrawal force. With light and sensitive profiles or strands this can give rise to a problem with respect to the quality of the product or to an increase in the waste level in production.

OBJECT OF THE INVENTION

The invention has as its object to improve a device for withdrawing a bar so that the aforementioned drawbacks can be overcome and especially light profiles or strands can be made without loss of quality.

SUMMARY OF THE INVENTION

This object is achieved in accordance with the invention in that a second slide or carriage is arranged on the first slide or carriage and is movable relative to the first slide or carriage in the withdrawal direction. The bar to be withdrawn is engaged with the second carriage.

Through this feature, the entire carriage mass is subdivided into two parts. The first carriage can be moved as has been known. Deviations from a predetermined withdrawal force upon the bar, which can be constant or can vary in accordance with a predetermined function, are compensated by a corresponding dynamic regulation of the second carriage, that is the deviations from the predetermined withdrawal force can be eliminated by the control. Since the second carriage has only a relatively small mass to be moved, the system has a substantially higher dynamic response and enables the predetermined withdrawal force to be maintained with substantially greater precision. The withdrawal force applied to the stand can thus maintain a predetermined profile or pattern or value.

According to a further feature, it is provided that for movement of the second carriage relative to the first carriage, a motor means is used. This motor means is preferably a controllable motor, especially a servomotor.

Preferably the motor means connects the first and second carriages together through transmission means. the transmission means can advantageously be a rack and pinion system, a chain and sprocket system, a cog and cog wheel system or a cable and cable wheel system.

To provide a closed control circuit for the movement of the second carriage, at least one sensor can be arranged on the first and/or second carriage. The sensor should be of the type which is capable of measuring the acceleration of the second carriage (an accelerometer). This should be able to measure acceleration in a range of precision of ±1 g. Furthermore, a sensor can be provided which detects the position of the second carriage relative to the first carriage (displacement meter). Furthermore, a sensor can be provided which detects the force applied by the second carriage to the end of the bar or to the bar itself (force meter).

The measured signals from the sensor or from the sensors can be fed to the control and/or regulating means which, as a function of the detected measured values by the sensor or the sensors, influences the withdrawal force applied to the bar by the motor means. Above all it is contemplated here that the control and/or regulating means influence the torque of the motor means.

An exact control of the withdrawal force can be measured when the mass of the first carriage is at least double, preferably at least five times to at least ten times the mass of the second carriage.

The device can have more than one first carriage with respective second carriages. The first carriages can then be arranged in cascade one after another in the withdrawal direction.

With the proposed configuration, it can be achieved that the withdrawal force which is applied to the bar can be controlled with precision to a predetermined value or in accordance with a predetermined course or pattern, since the system of the invention enables highly dynamic response which permits a precise response to an actual value based upon a predetermined set-point value.

Further details and features of the invention are given in the claims and the description of an embodiment illustrated in the drawing of the invention.

SPECIFIC DESCRIPTION

Figure 1:
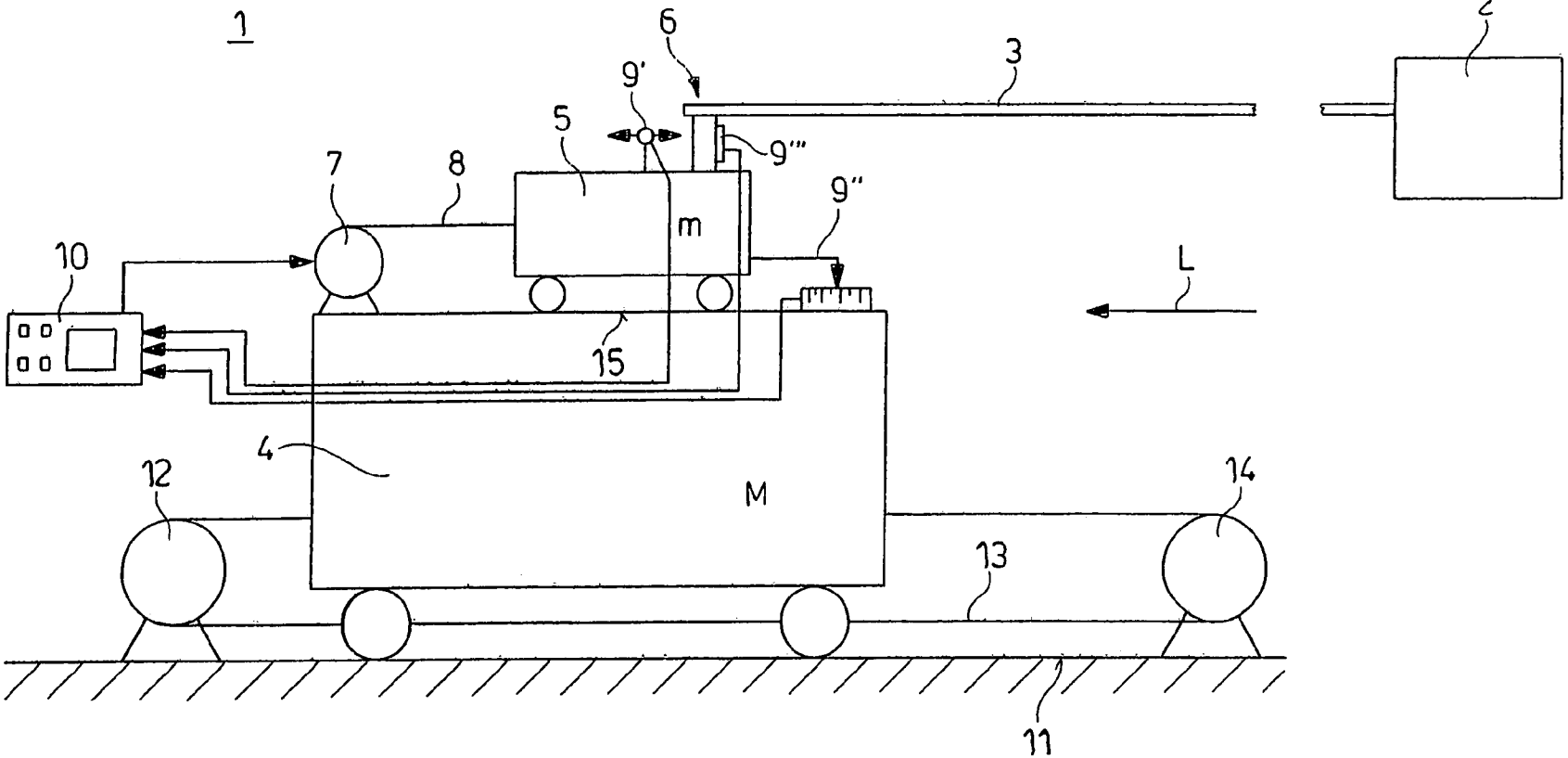
FIG. 1 is a schematic illustration of a withdrawing device for a bar produced in a bar or tube extrusion press.

In FIG. 1 the conceptional layout of a withdrawing device 1 has been illustrated only highly schematically. In a long known bar or tube extrusion press 2, not shown in greater detail, a bar 3 is extruded which leaves the bar or tube press 2 in a withdrawal direction L. To ensure a high quality bar 3, it is withdrawn by the withdrawal device 1 in the withdrawal direction L with a predetermined withdrawal force.

The withdrawal force can be constant or it can vary along the withdrawal path in accordance with a predetermined function or course (compare EP 0 300 262 B1). So that especially also light profiles or strands can be fabricated with high quality, the withdrawal force which is applied by the withdrawal device 1 to the bar 3 must be maintained with the greatest of precision and for that purpose the withdrawal device 1 has the following construction:

A first slide or carriage 4 is displaceable on a linear guide 11 in the withdrawal direction L to apply the withdrawal force. A motor 12 is provided which can effect the linear movement of the first carriage 4 by a belt 13 and a rerouting roller 14.

On the first carriage 4 there is a linear guide 15 on which a second carriage 5 is disposed so as to be linearly shiftable relative to the first carriage 4 in the withdrawal direction L. The front end 6 of the bar 3 to be withdrawn is connected with the second carriage 5. The second carriage 5 is moved relative to the first carriage 4 by motor means 7 and transmission means 8. The motor means 7 is preferably a controllable synchronous servomotor. As the transmission means 8, a rack and pinion system has been found to be suitable.

The withdrawal device 1 is equipped with sensors 9', 9", and 9'" which permit process parameters to be detected. The process parameters being those which may influence the withdrawal force which is applied by the withdrawal device 1 to the front end 6 of the bar 3. In the example, especially an acceleration sensor 9' is provided which detects the acceleration of the second carriage. In addition, a displacement sensor 9" is provided which measures the displacement or relative position of the first side 4 to the second slide 5. A force sensor 9'" detects the withdrawal force applied to the end 6 of the bar 3. The data detected by the sensors 9', 9" and 9'" is applied to a control or regulator means 10. In the latter, especially a set-point withdrawal force has been stored and is the force which should be applied to the end 6 of the bar 3. This withdrawal force can be variable as a function of the displacement. The control and/or regulating means 10 acts upon the motor means 7 and influences here especially the torque which is produced by the motor means 7.

The first slide or carriage 4 has a mass M and the mass of the second slide or carriage is designated with m. To achieve a dynamic response of the control system, the mass of the first carriage 4 should be at least five times and preferably at least ten times the mass m of the second carriage 5. The mass m of the second carriage is thus advantageously an order of magnitude smaller than the mass M of the first carriage 4. A high dynamic response of the system can be thus ensured first by keeping the moment of inertia of the motor means 7 small. Furthermore, the dynamic advantages of the system can be maintained by a stiff construction of the transmission 8, e.g. in the form of a rack and pinion system, thereby positively influencing the dynamic response.

The friction force between the first carriage and the second carriage can be held close to proportional to the speed by a precise machining of the linear guide 15 and shielding it from dirt. The friction force can thus be compensated by the computer component of the control and/or regulating means 10.

The inertia of the second carriage 5 is especially low because of the low mass m of the second carriage so that maintaining the withdrawal force is more easily controllable than with conventional systems.

The first carriage 4 can be driven in known manner with positive control. The friction between the first carriage 4 and its linear guide 11 and the effect of the relatively large mass M of the first carriage 4 no longer impacts negatively upon the withdrawal force in the bar sensor, since maintaining a predetermined value for the withdrawal force involves corresponding control of the motor means 7 and thus the movement of the second carriage.

Figure 2:
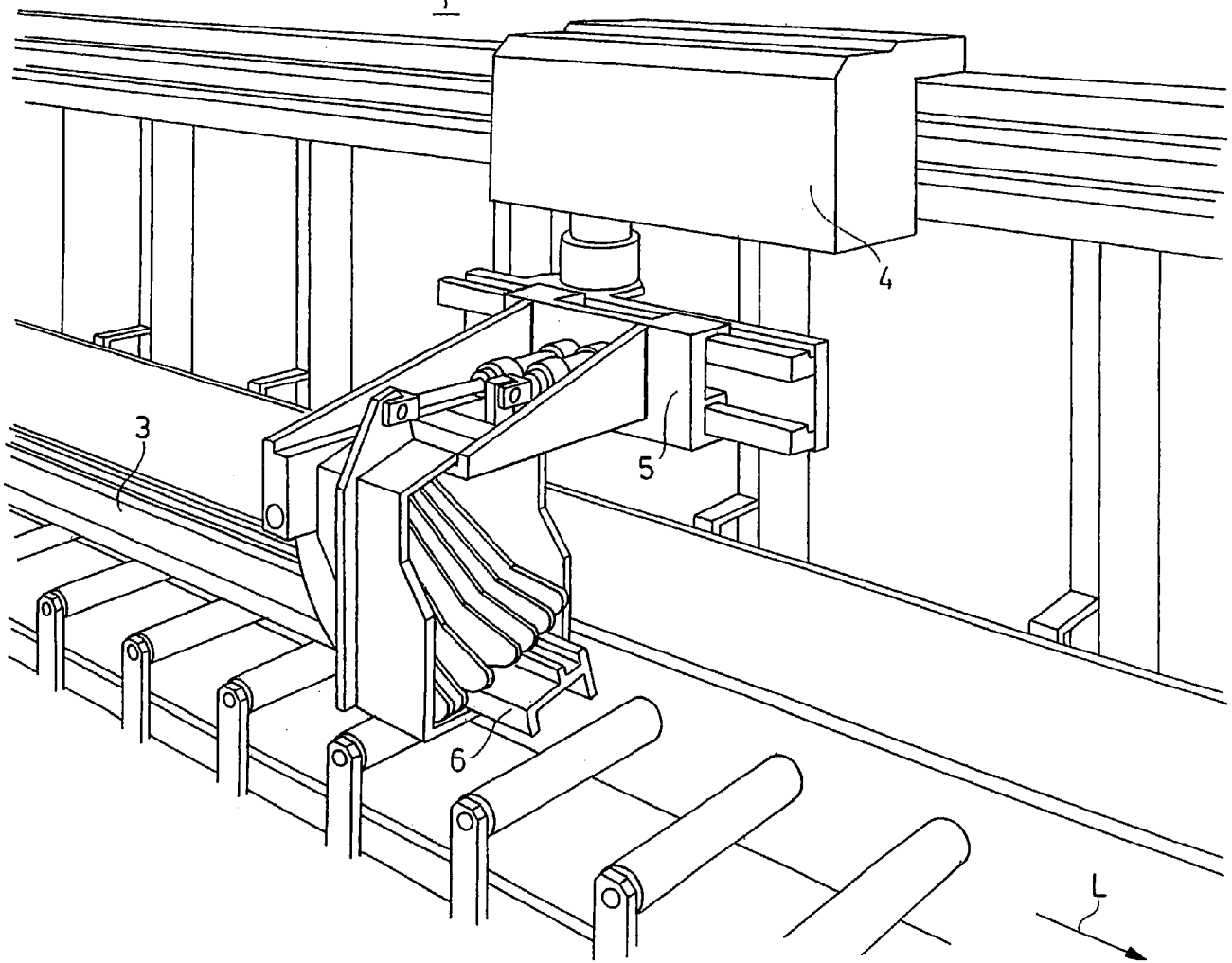
FIG. 2 the withdrawing device in a three dimensional view.

In FIG. 2 The withdrawal device 1 has been shown again in a perspective view.

Figure 3:
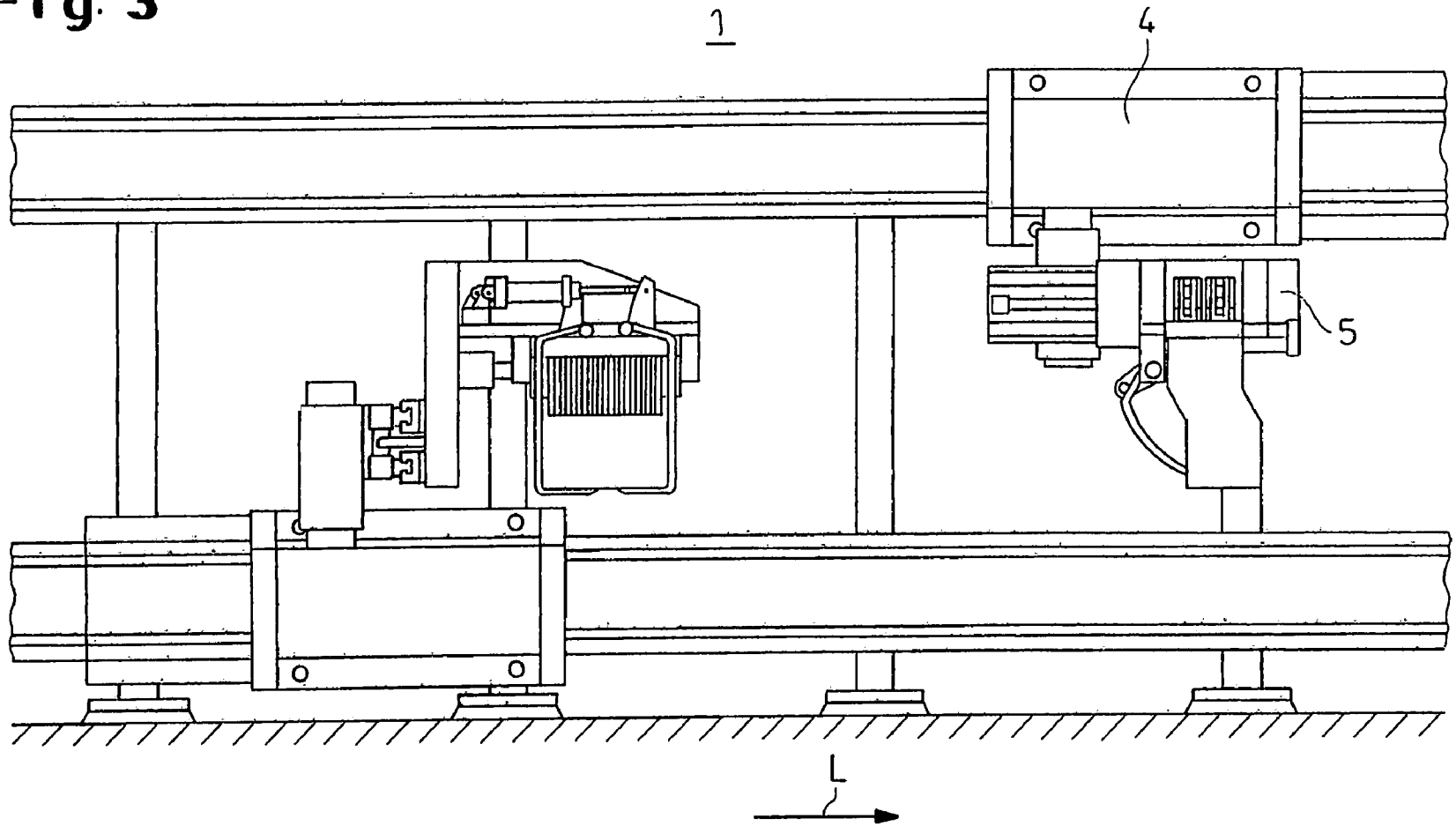
FIG. 3 a side view of the withdrawing device.
Figure 4:
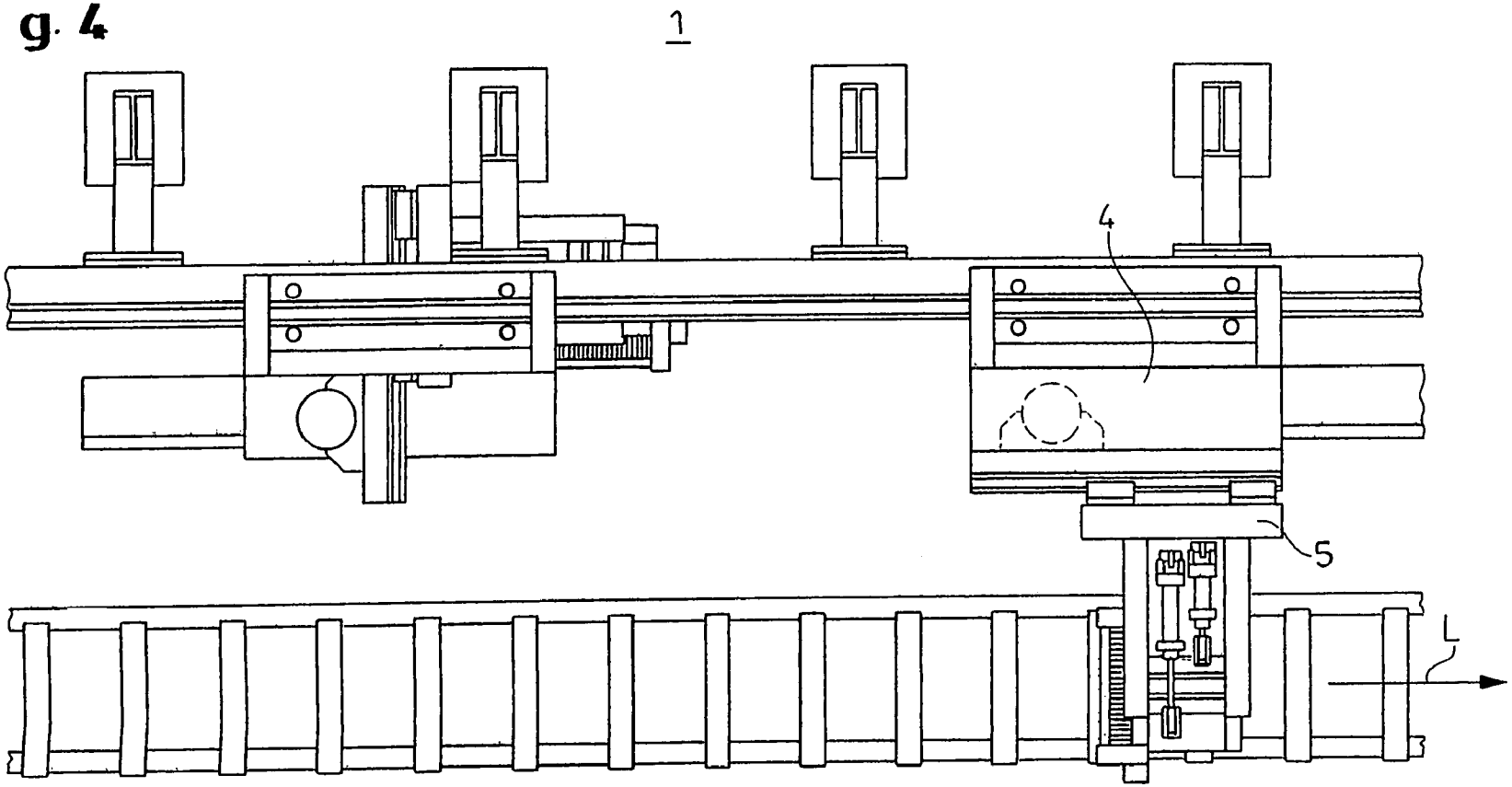
FIG. 4 the withdrawing device of FIG. 3 in plan view.
Figure 5:
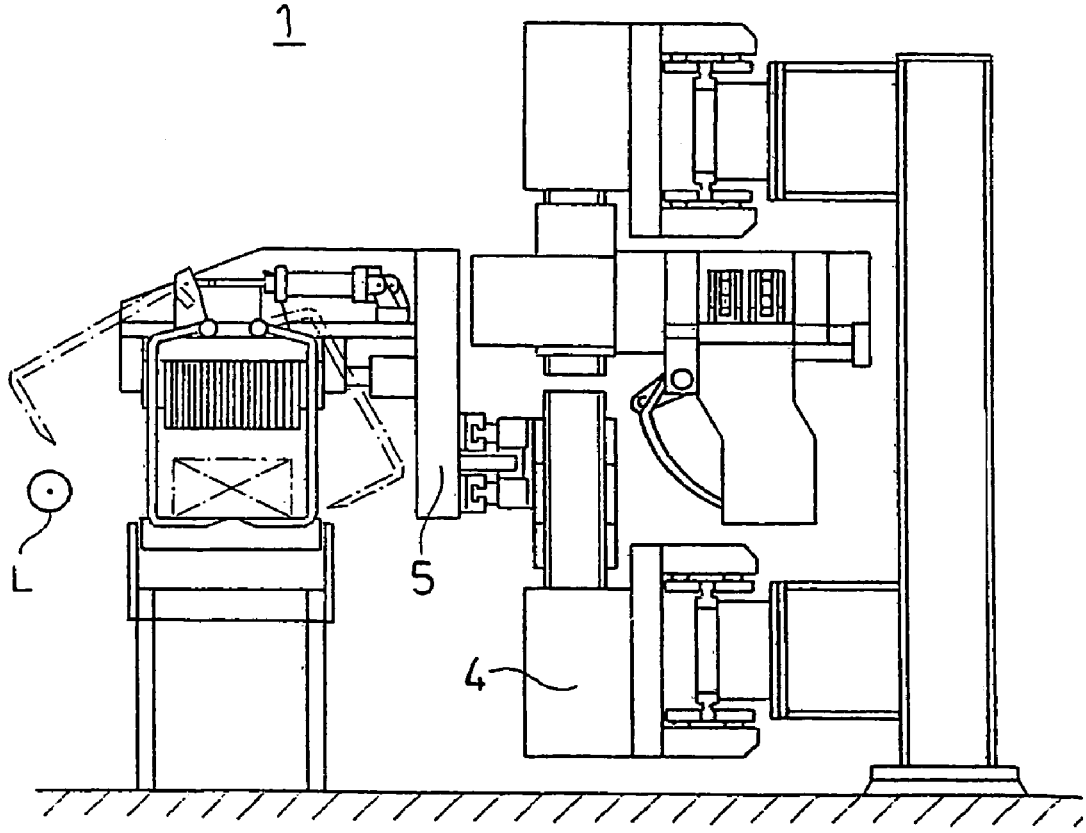
FIG. 5 the withdrawing device of FIG. 3 in an end view.

FIGS. 3, 4 and 5 show the withdrawal device in side view plan view and end view. The reference numerals used there correspond to the previously described components or means.

The system can also be configured as a double withdrawal device which can withdraw one or more strands of the extruded light metal profiles and displace them.

For this purpose, two first carriages are displaceable independently from one another on the liner guide 11 (see FIG. 4) so that a hand-over-hand operation or so called alternating operation, with "flying saw" or a conventional operation with a first carriage 4 is provided. The linear guide can be mounted laterally of the outlet path of the bar 3 on the factory floor.

The double withdrawal device can have respective tracks for the two carriages whereby a mounting on a truss or support construction laterally of the outlet path of the bar is possible. On the respective second carriages, pneumatically operating profile clamping devices with clamping segments which match the profile contour can be provided to ensure metallic gripping of the front ends 6 of the bars 3.

The withdrawal device in accordance with the principles explained can be made still finer by providing on the second carriage thus optionally further carriages which like the second carriage can be separately driven.

The invention claimed is:

1. In combination with a press that outputs an elongated workpiece in a direction, a withdrawing device comprising:

a first guide extending in the direction;

a first carriage displaceable in the direction along the first guide;

first motor means for displacing the first carriage in the direction along the first guide;

a second guide extending in the direction on the first carriage;

a second carriage displaceable in the direction on the second guide, whereby the second carriage can move relative to the first carriage;

means for clamping the workpiece to the second carriage;

second motor means separate from the first motor means for displacing the second carriage on the second guide; and control means connected to the first motor means and to the second motor means for shifting the second carriage in the direction at a speed independent of a speed of the first carriage while the first carriage is moving in the direction.

2. The withdrawing device defined in claim 1 wherein the second motor means includes a servomotor.

3. The withdrawing device defined in claim 1 wherein the second motor means includes a motor mounted on the first carriage and a transmission element connecting the motor to the second carriage.

4. The withdrawing device defined in claim 1 wherein the control means includes a sensor on at least one of the carriages.

5. The withdrawing device defined in claim 4 wherein the sensor is an accelerometer connected to the second carriage.

6. The withdrawing device defined in claim 4 wherein the sensor detects a position of the second carriage on the first carriage.

7. The withdrawing device defined in claim 4 wherein the sensor detects a traction force applied by the second carriage to the workpiece.

8. The withdrawing device defined in claim 4 wherein the control means displaces the second carriage on the first carriage in accordance with an output of the sensor.

9. The withdrawing device defined in claim 4 wherein the control means can vary a torque output of the second motor means.

10. The withdrawing device defined in claim 4 wherein the first carriage has a mass equal to at least twice a mass of the second carriage.

* * * * *